US007325875B1

(12) United States Patent
Guerrini

(10) Patent No.: US 7,325,875 B1
(45) Date of Patent: Feb. 5, 2008

(54) BEACH CHAIR

(76) Inventor: Derrek Guerrini, 71 Gleason Ave., West Yarmouth, MA (US) 02673

( * ) Notice: Subject to any disclaimer, the term of this patent is extended or adjusted under 35 U.S.C. 154(b) by 0 days.

(21) Appl. No.: 11/723,054

(22) Filed: Mar. 16, 2007

(51) Int. Cl.
*A47C 1/14* (2006.01)

(52) U.S. Cl. ..... 297/344.21; 297/344.26

(58) Field of Classification Search ..... 297/344.21, 297/344.26; 248/349.1, 425, 521
See application file for complete search history.

(56) References Cited

U.S. PATENT DOCUMENTS 5,580,129 A * 12/1996 Findlay ..... 297/344.21
6,315,360 B1 * 11/2001 Guerrini ..... 297/344.21
6,890,033 B1 * 5/2005 Casella ..... 297/344.21

* cited by examiner

*Primary Examiner*—Anthony D. Barfield
(74) *Attorney, Agent, or Firm*—Stephen R. Greiner

(57) ABSTRACT

A beach chair including a seat having rigid, yet collapsible, frame. The frame carries a flexible platform for supporting the buttocks of a person seated upon the seat and a flexible backrest with shoulder straps secured thereto for supporting the back of a person seated upon the seat and permitting the chair to be easily transported when not employed for seating purposes. The frame has a U-shaped forward support member with a pair of forward legs being connected together by a forward crosspiece for maintaining the front of the platform at a fixed height above the ground. The frame also has a U-shaped rearward support member with a pair of rearward legs being connected together by a rearward crosspiece for maintaining the rear of the platform at a fixed height above the ground. A swivel apparatus is attached to the seat and is provided with a load-distributing platform for positioning upon the ground. A saddle is pivotally secured atop the platform for supporting the seat above the ground. A pair of mounting clips is secured to the front of the saddle for firmly, yet releasably, grasping the forward crosspiece of the seat. A mounting bracket is secured to the rear of the saddle for holding the rearward crosspiece.

2 Claims, 4 Drawing Sheets

14
100
126
144
146
146
124
204
98
198
202
102
118
116
120
122
110
112
114
104
108
94
106
194
188
186
192
190
172
178
180
182
96
200
174
176
170
182
180
184
76
196

BEACH CHAIR

FIELD OF THE INVENTION

The present invention relates generally to chairs and seats and, more particularly, to an apparatus for moving the bottom and back of a chair as a unit about a vertical axis.

BACKGROUND OF THE INVENTION

In patents issued in the past, I described an apparatus that permits a beach chair of conventional construction to be swiveled about a vertical axis. A person seated in a chair carried by this apparatus can, with minimal effort, turn in any direction. Such a capability makes it easy to keep track of one's mobile children at a beach. Additionally, sunbathing opportunities are enhanced since a user can turn toward the sun as it tracks across the sky. Away from the beach, the apparatus can be used to follow the action at outdoor sporting events and barbecues.

Over time, I improved my apparatus. First, the apparatus was reinforced to make it stronger and more stable on sandy ground. Then, it was adapted for universal attachment to different makes and models of beach chairs. Unfortunately, some considered the improved apparatus to be bulky and difficult to transport even though it was supplied with handholds. I have, now, come to conclude that permanently combining my apparatus with a collapsible beach chair and, then, making the combination easy to tote would benefit users and enhance sales.

SUMMARY OF THE INVENTION

In light of the problems associated with the known chairs capable of swiveling, it is a principal object of the invention to provide a chair of the sort that can fold or collapse into a small volume and that can be transported from place to place upon the back of a user in the manner of a backpack. Collapsing can be accomplished without resort to tools or prolonged periods of training. My chair, it is believed, is intuitive to use.

It is another object of the invention to provide a chair of the type described that can lie atop beach sand with a minimum of penetration and with a minimum of sideways sliding while supporting a user.

It is an object of the invention to provide improved features and arrangements of features in a chair for the purposes described that is lightweight in construction, compact in size, easy to transport, inexpensive to manufacture, and fully dependable in use.

The foregoing and other object and advantages of the present invention will become readily apparent upon further review of the following detailed description of the chair embodiment illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
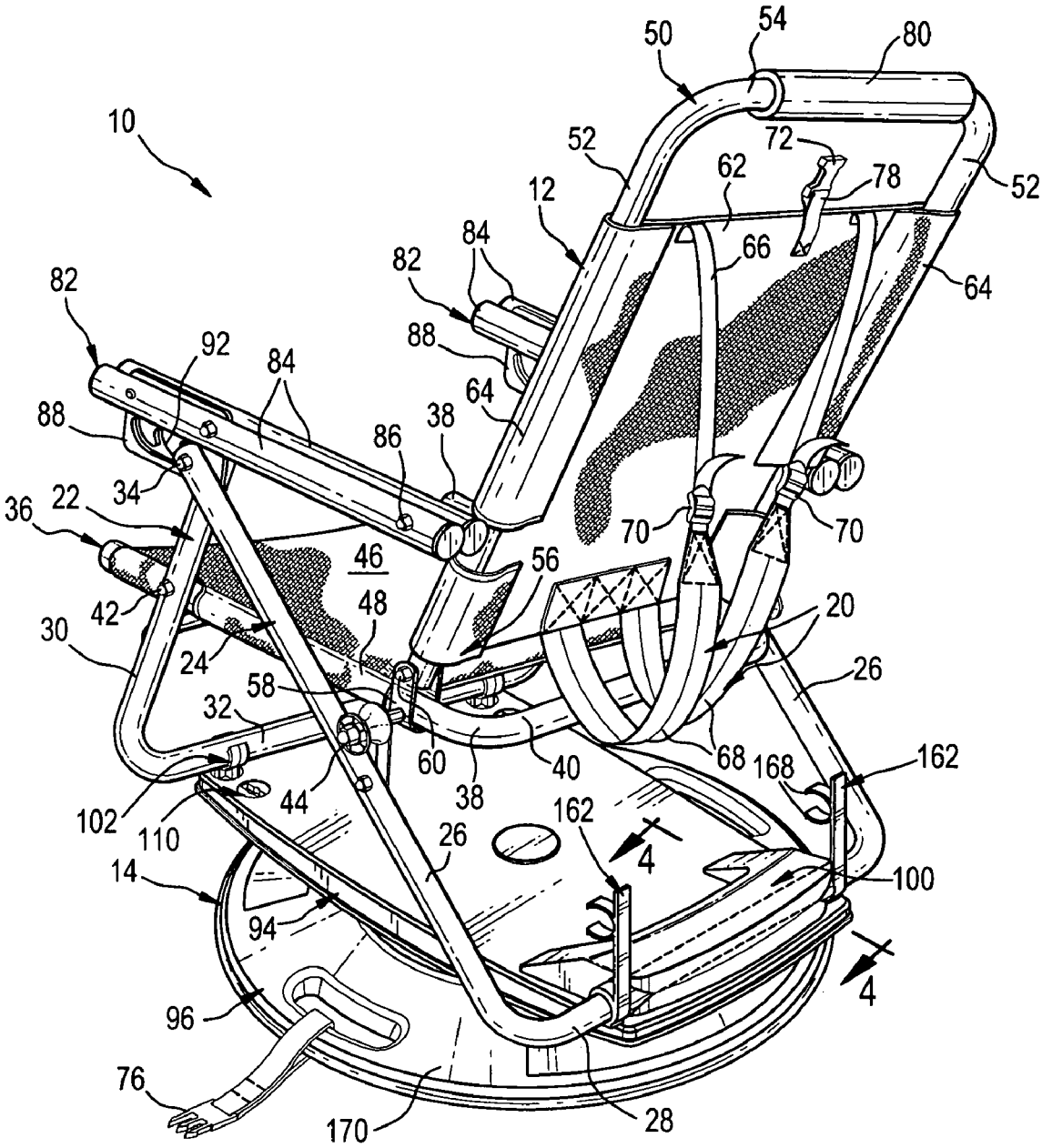
FIG. 1 is a perspective view of an opened beach chair in accordance with the present invention.

Referring now to the FIGS., a beach chair in accordance with the present invention is shown at 10. Chair 10 includes a collapsible seat 12 and a swivel apparatus 14 connected to the bottom of seat 12. To transport chair 10 long distances, seat 12 is partially disconnected from swivel apparatus 14, folded up, and secured to the shoulders 16 of a user 18 by means of a pair of shoulder straps 20.

Seat 12 includes a forward support member 22 and a rearward support member 24 that, together, comprise the base of seat 12. Member 24 has a pair of rearward legs 26 positioned side-by-side and connected together by a rearward crosspiece 28 in a U-shaped arrangement. Member 22, however, has a pair of forward legs 30 positioned side-by-side between legs 26 and connected together by a forward crosspiece 32 in a U-shaped arrangement. The free end of each of legs 30 is positioned adjacent the free end of a respective one of legs 26. One of a pair of pins 34 extends through the adjacent free ends so as to pivotally connect members 22 and 24 together.

Seat 12 has a platform support member 36 that transmits the weight of a user to members 22 and 24. Member 36 has a pair of platform braces 38 positioned side-by-side and connected together by a platform cross brace 40. As shown, braces 38 are positioned between legs 26 and 30 with the free end of each brace 38 being pivotally connected to the midpoint of a respective one of legs 30 by one of a pair of pins 42.

A pair of rollers 44 is affixed to platform support member 36 to support the rear end of member 36 above member 24. A respective one of rollers 44 is affixed to each of braces 38 near its connection with cross brace 40. Each of rollers 44 is hourglass shaped to receive one of rearward legs 26 between its wide ends and to roll freely along the top of a rearward leg 26.

A flexible platform 46, formed of durable fabric, is stretched between braces 38. Platform 46 is rectangular in outline and has opposite sides that are folded over and seamed to form sleeves 48 within which braces 38 are positioned. Platform 46 is dimensioned so that a taut, horizontal supporting surface is provided for the buttocks of a person seated upon chair 10.

A backrest support member 50 is pivotally connected to member 36 for retaining a person seated upon chair 10 in an upright position. Member 50 has a pair of backrest braces 52 positioned side-by-side and connected together by a backrest cross brace 54. Braces 52 are located above braces 38 with the free end of each brace 52 being pivotally connected to the rear end of a respective one of braces 38 by one of a pair of hinges 56. Each hinge 56 has a U-shaped bracket 58 affixed to the rear end of a brace 38 and a pivot pin 60 that passes through a brace 52 and bracket 58.

A flexible backrest 62, formed of durable fabric, is stretched between braces 52. Like platform 46, backrest 62 is rectangular in outline and has opposite sides that are folded over and seamed to form sleeves 64 within which braces 52 are positioned. Backrest 62 is dimensioned so that a taut, upright supporting surface is provided for the back of a person seated upon chair 10.

A pair of shoulder straps 20 is affixed to backrest 62. Each shoulder strap 20 includes a strip of webbing 66 that is sewn at one of its ends to the top of backrest 62. Each shoulder strap 20 also includes an elongated pad 68 that is sewn at one of its ends to the bottom of backrest 62. A clasp 70 is sewn onto the free end of each pad 68 by means of which the free end of a webbing strip 66 is adjustably fastened to a pad 68.

The female portion 72 of a clip 74 is secured to the top of backrest 62 and can be selectively attached to the male portion 76 of clip 74 that is secured to swivel apparatus 14 to help retain seat 12 in a collapsed condition for easy transport. As shown, a loop of webbing 78 extends through female portion 72 and is sewn to backrest 62. Webbing loop 78 is positioned midway between webbing strips 66 at the middle of backrest 62.

A tubular, foam pad 80 is secured to backrest support member 50. Pad 80 encircles cross brace 54 to isolate cross brace 54 from the upper body of a person sitting upon seat 12. Furthermore, pad 80 prevents the back of the legs of user 18 from rubbing against seat 12 while seat 18 is being transported like a backpack.

Seat 12 has a pair of arms 82 for supporting those of a person seated therein. Each of arms 82 has a pair of abutting rails 84. The back ends of each pair of rails 84 are pivotally connected to the bottom end of a respective one of backrest braces 52 by a pin 86. The front ends of each pair of rails 84, on the other hand, carry a bracket 88 therebetween for adjusting the inclination of backrest 62. Each bracket 88 has a central opening 90 for loosely receiving a pin 34 between legs 26 and 30. Each opening 90 is provided with an irregular top surface that includes a number of forwardly and upwardly trending slots 92 into which a pin 34 is selectively extended. When pin 34 is located in a forwardly positioned slot 92, backrest 62 is reclined to a great degree. When, however, pin 34 is located in a rearwardly positioned slot 92, backrest 62 is held in an upright orientation.

Swivel apparatus 14 includes a saddle 94 attached to a load-distributing platform 96 by a pivot pin 98 that permits saddle 94 to rotate about a vertical axis when platform 96 is positioned upon the ground. A mounting bracket 100 permanently secures rearward crosspiece 28 of seat 12 to the rear of saddle 94. A pair of clips 102 releasably secure forward crosspiece 32 to the front of saddle 94. Disengaging crosspiece 32 from clips 102 permits seat 12 to be easily collapsed for storage and transport.

Saddle 94 includes a rectangular plate 104 having a peripheral lip 106 for reinforcement purposes. At the center of plate 104 is a pivot pin receiver 108. Located at each of the corners of plate 104 is a pair of recessed keyholes 110 like those described in U.S. patent application Ser. No. 11/403,124, filed by me on Apr. 13, 2006, which is incorporated for all purposes herein. Each keyhole 110 includes a circular bore as at 112 at its center. From opposite sides of bore 112 one of a pair of rectangular slots as at 114 radiates outwardly.

A pair of clips 102 is connected to saddle 94 with each being respectively located within one keyhole 110 at each front corner of platform 96. Each clip 102 has a base 116 for connection to saddle 94 and a pair of arcuate jaws 118 affixed to base 116 for a "snap-fit" connection to crosspiece 32. Base 116 includes a downwardly extending shaft 120. At the free end of shaft 120 is affixed a key bit 122 being a rod oriented at right angles to shaft 120 and sized for passage through each keyhole 110. After passage of key bit 122 through a keyhole 110, the associated clip 102 is rotated 90° to lock the clip 102 snugly upon platform 96.

Mounting bracket 100 is connected to the rear end of saddle 94. Bracket 100 has a base portion 124 and a cover portion 126 that, together, grasp crosspiece 28 and connect such to saddle 94. Base portion 124 includes a wedge 128 that extends from one side of saddle 94 to the other. Wedge 128 has a channel 130 in the top thereof that extends the length of wedge 128 and is semicircular in cross section so as to snugly engage the bottom of crosspiece 28. A pair of pins 132 extends downwardly from the bottom of wedge 132 for snug positioning in opposed keyholes 110 in the rear of saddle 94. Each pin 132 includes a cylindrical stem 134 at its center, for snug positioning in a circular bore 112, from which two, rectangular wings 136, for positioning in slots 114, extend respectively forward and rearward. Adjacent the free end of each wing 136, wedge 128 is provided with an aperture 138 for the passage of a threaded fastener 140 for joining base portion 124 and cover portion 126.

Cover portion 126 includes a block 144 from the front of which a pair of feet 146 extend forwardly in a U-shaped configuration. As shown, block 144 has a cutout, defined by top wall 148 and front wall 150, in its bottom and at its rear end to fully receive base portion 124. A semicircular channel 152 is provided in top wall 148 that extends the length of block 144 for snugly engaging the top of crosspiece 28. A pair of apertures 154 is provided at each end of block 144 for alignment with apertures 138 and for receiving threaded fasteners 140.

Feet 146 evenly distribute loads from seat 12 to saddle 94. Each foot 146 is provided with a vertical bore 156 for the downward passage of a bolt 158. Bores 156 are axially aligned with the circular bores 112 of the forwardmost keyholes 110 at the rear end of saddle 94 when pins 132 are positioned in the rearwardmost keyholes 110 at the rear end of saddle 94. The threaded stem of bolt 158 extends from the bottom of a foot 146 and through a bore 112 and is locked there by a nut 160 turned onto bolt 158 and engaged with the bottom of platform 96.

Adjacent each of the opposite ends of bracket 100, a flexible clasp 162 is secured to crosspiece 28 to assist in retaining seat 12 in a collapsed state for storage and transport. Each clasp 162 has a tubular sleeve 164 that fits snugly over crosspiece 28. An elongated stem 166 is affixed to sleeve 164 and extends upwardly therefrom. A pair of arcuate jaws 168 is affixed to the free end of stem 166 and extends forwardly therefrom. Jaws 168 are adapted for a "snap-fit" connection to lower cross brace 40.

Load-distributing platform 96 is an inverted bowl with a downwardly extending rim 170 at the periphery thereof and an upwardly extending sealing ring 172 that is spaced inwardly from rim 170. At the center of platform 96 is located a pivot pin anchor receiver 174. At spaced intervals around receiver 174 and within ring 172, platform 96 has dimples 176 sized to receive and hold ball bearings 178.

Platform 96 has a pair of integral handles 180 for ease in carrying chair 10. Handles 180 are formed by making a pair of slots 182 in platform 96 between ring 172 and rim 170 180° apart.

A loop of webbing 184 secures male portion 76 of a clip 74 to one of handles 180. In use, male portion 76 is selectively attached to female portion 72 on backrest 62 to retain seat 12 in a collapsed condition for easy storage and transport.

A friction reducing mechanism 186 facilitates the rotation of saddle 94 on pivot pin 98. Mechanism 186 includes ball bearings 178 set in dimples 176 in platform 96. Mechanism 186 also includes a circular bearing race 188 joined by screws 190 to the bottom of saddle 94. Race 188 has a circumferential channel 192 for engaging ball bearings 178. Dirt is prevented from fouling bearings 178 by an annular seal 194.

Pivot pin 98 secures saddle 94 to platform 96. Pivot pin 98 comprises a bolt extending downwardly through pivot pin receiver 108 and into pivot pin anchor receiver 174 wherein pivot pin 98 threadably engages a nut 196. To distribute loads, one washer 198 is provided directly beneath the head of pin 98 and another washer 200 is provided atop platform 96. A sleeve 202 is also fitted around the threaded portion of pin 98 within receiver 108 to minimize friction as saddle 94 is rotated relative to platform 96. A cover 204 is fitted over pivot pin 98 to prevent pin 98 from becoming fouled.

Figure 2:
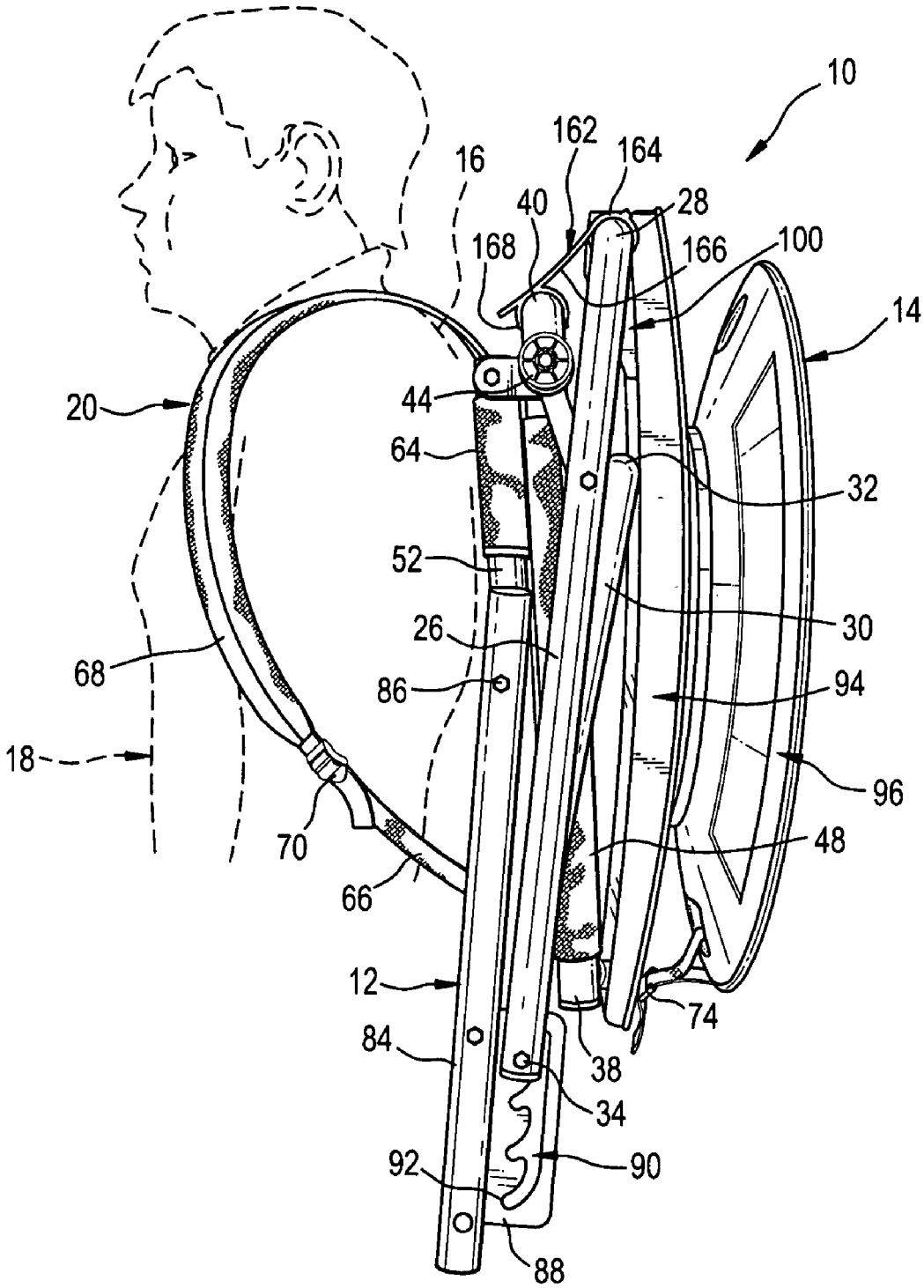
FIG. 2 is a side view of the beach chair of FIG. 1 in a collapsed state and being worn as a "backpack" for transport.
Figure 3:
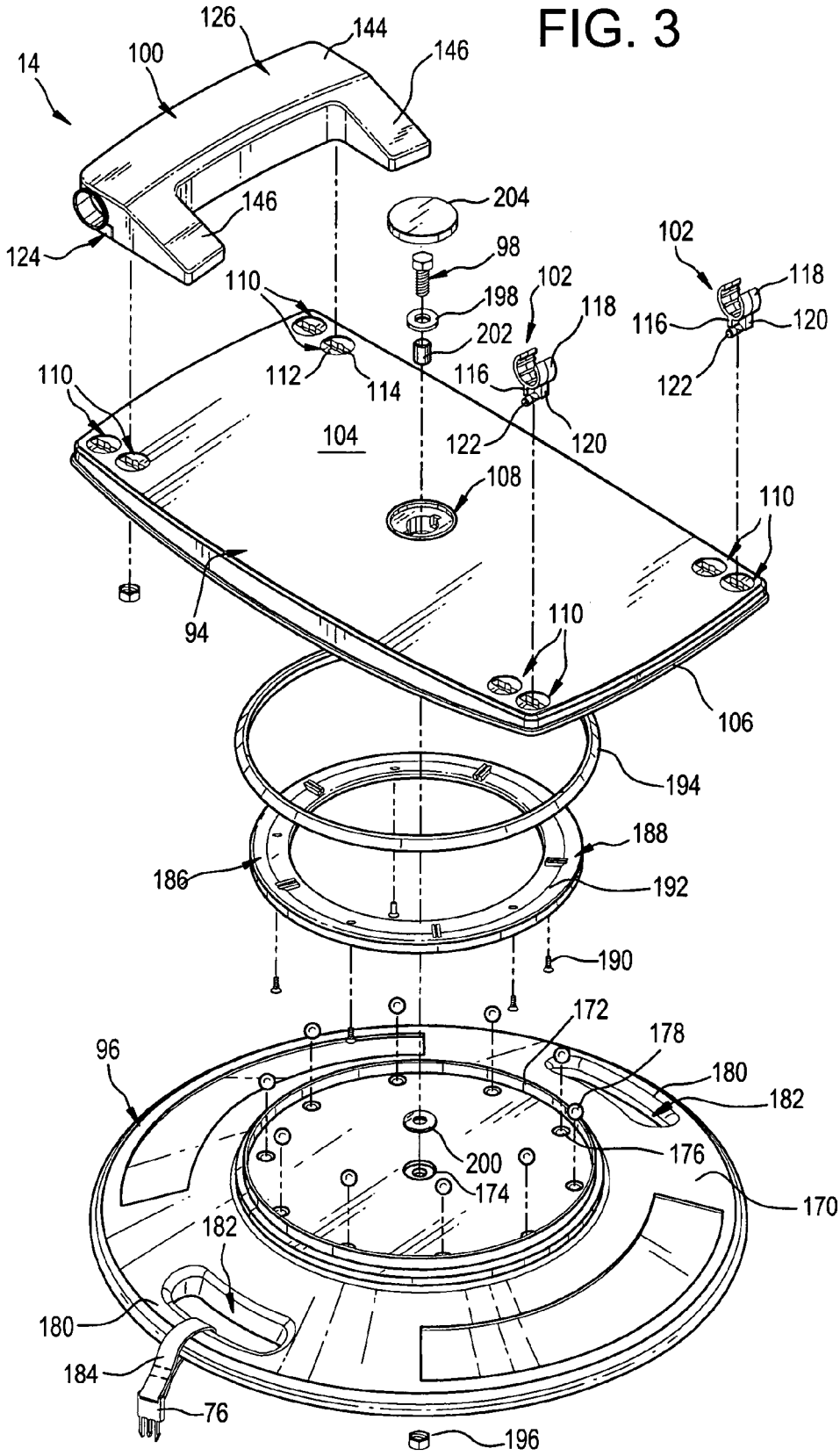
FIG. 3 is an exploded perspective view of the base portion of the beach chair.
Figure 4:
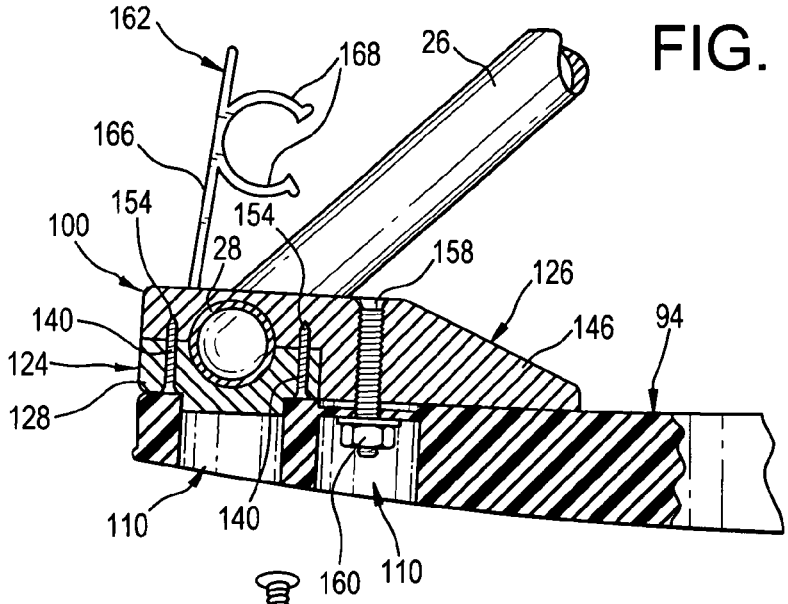
FIG. 4 is a cross-sectional view taken along line 4-4 of FIG. 1.
Figure 5:
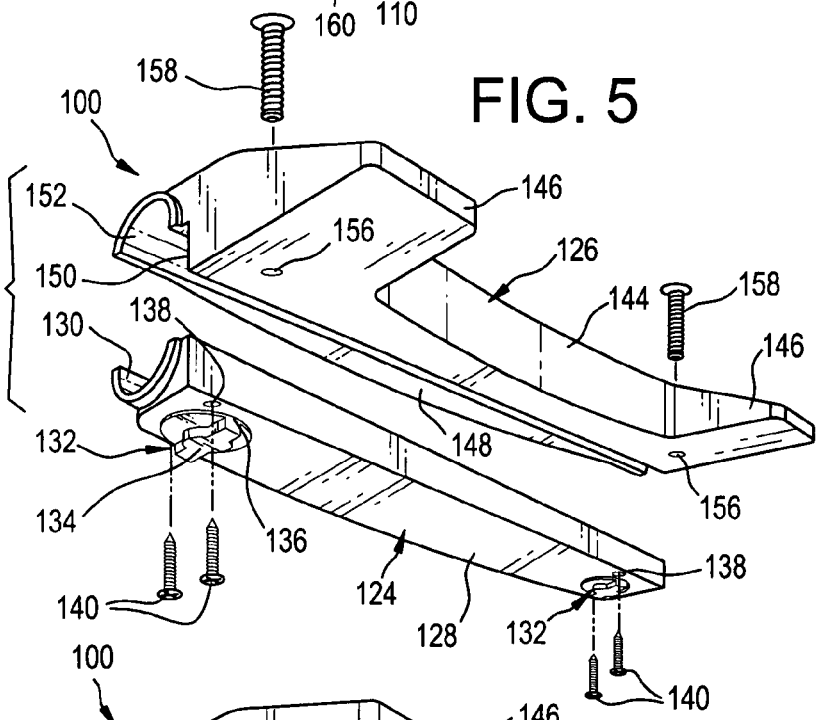
FIG. 5 is an exploded perspective view of the chair-retaining bracket of the base portion of the beach chair.
Figure 6:
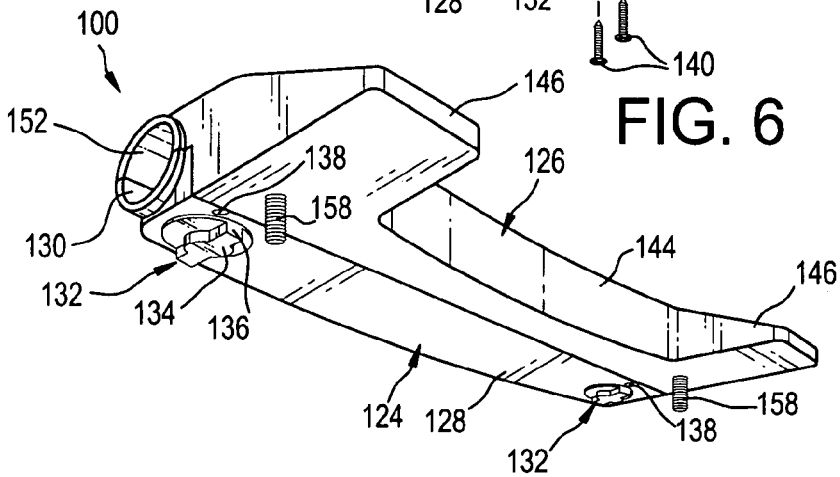
FIG. 6 is a perspective view of the chair-retaining bracket.

Use of chair 10 is straightforward and is initiated by unfolding it. First, with chair 10 in a collapsed state as shown in FIG. 2, chair 10 is removed from the back of user and placed on the ground. Then, jaws 168 of flexible clasps 162 are manually detached from lower cross brace 40 by lightly pushing the two features apart. Next, male portion 76 and female portion 72 of clip 74 are disengaged from one another by squeezing the sides of male portion 76 while simultaneously pulling male portion 76 from female portion 72. Seat 12 is now telescoped by lifting upper cross brace 54 with support members 22 and 24 and platform brace 36 cascading downwardly from backrest support member 50.

Once seat 12 is unfolded, it will be seen that cross brace 32 automatically aligns itself with the forwardmost pair of keyholes 110 at the front of saddle 94. Into these keyholes 110, clips 102 are installed by passing key bits 122 through keyholes 110 and, then, pivoting clips 102 90° to align jaws 118 with cross brace 32. Next, cross brace 32 is pushed between jaws 118. A user can now position himself upon seat 12 and swivel in any direction desired. If the user finds that platform 46 is originally set too low, he can raise the platform 46 by moving clips 102 to the rearward pair of keyholes 110 at the front of saddle 94. Of course, the tilt of backrest 62 can be adjusted to the tastes of a user by the selective engagement of pins 34 with bracket slots 92.

After use, chair 10 is collapsed by reversing the steps delineated above. Chair 10, in a folded state, is easily transported and stored. Moving chair 10 relatively long distances is accomplished by positioning shoulder straps 20 over the shoulders 16 of a user 18. Pads 68 prevent chair 10 from chafing the shoulders and clasps 70 permit the lengths of shoulder straps 20 to be adjusted to accommodate users of different statures. Being compact in size, chair 10 is easily stored in an automobile trunk or closet for immediate reuse.

While chair 10 has been described with a high degree of particularity, it will be appreciated by those skilled in the art that modifications can be made to it. For example, seat 12 can be provided with a rigid framework of practically any sort provided that cross pieces 28 and 32 are provided for attachment to swivel apparatus 14. Thus, it is to be understood that the present invention is not limited to chair 10 described above, but encompasses any and all chair embodiments within the scope of the following claims.

I claim:

1. A beach chair, comprising:

a seat having rigid, yet collapsible, frame carrying a flexible platform for supporting the buttocks of a person seated upon said seat and a flexible backrest with shoulder straps secured thereto for supporting the back of a person seated upon said seat and permitting said chair to be easily transported when not employed for seating purposes, said frame having a U-shaped forward support member with a pair of forward legs being connected together by a forward crosspiece for maintaining the front of said platform at a fixed height above the ground, and said frame also having a U-shaped rearward support member with a pair of rearward legs being connected together by a rearward crosspiece for maintaining the rear of said platform at a fixed height above the ground;

a swivel apparatus being attached to said seat, said apparatus including:

a load-distributing platform for positioning upon the ground;

a saddle being pivotally secured atop said platform for supporting said seat above the ground;

a pair of mounting clips being secured to the front of said saddle for firmly, yet releasably, grasping said forward crosspiece of said seat;

a mounting bracket being secured to the rear of said saddle for holding said rearward crosspiece, said mounting bracket including:

a base portion with a first channel therein for snugly receiving the bottom of said rearward crosspiece;

a cover portion being positioned atop, and secured to, said base portion, said cover portion having a second channel therein for snugly receiving the top of said rearward crosspiece; and, a pair of threaded fasteners penetrating said cover portion and said saddle for securing said mounting bracket to said saddle.

2. The beach chair according to claim 1 wherein said frame has a rigid platform support member that carries said flexible platform and said chair further comprises:

a clip having a female portion tethered to the top of said flexible backrest and a male portion tethered to said load-distributing platform that, when said female portion and said male portion are mated, that retains said seat in a collapsed condition; and, a flexible clasp for retaining said seat in a collapsed condition, said clasp including: a tubular sleeve encircling said rearward crosspiece adjacent said mounting bracket, an elongated stem being secured to said tubular sleeve, and a pair of arcuate jaws being secured to said stem remote from said tubular sleeve for releasably grasping said rigid platform support member.

* * * * *